US011374315B2

(12) United States Patent
Bauman

(10) Patent No.: US 11,374,315 B2
(45) Date of Patent: Jun. 28, 2022

(54) COMPACT AND LOW-PROFILE DIRECTIONAL ANTENNA ARRAY

(71) Applicant: Mark Bauman, College Place, WA (US)

(72) Inventor: Mark Bauman, College Place, WA (US)

( * ) Notice: Subject to any disclaimer, the term of this patent is extended or adjusted under 35 U.S.C. 154(b) by 0 days.

(21) Appl. No.: 17/194,205

(22) Filed: Mar. 5, 2021

(65) Prior Publication Data

US 2021/0288404 A1 Sep. 16, 2021

Related U.S. Application Data

(60) Provisional application No. 63/100,411, filed on Mar. 10, 2020.

(51) Int. Cl.
*H01Q 21/26* (2006.01)
*H01Q 3/26* (2006.01)
*H01Q 1/48* (2006.01)

(52) U.S. Cl.
CPC ..... *H01Q 3/2682* (2013.01); *H01Q 1/48* (2013.01); *H01Q 21/26* (2013.01)

(58) Field of Classification Search
CPC ..... H01Q 1/48; H01Q 21/26
See application file for complete search history.

(56) References Cited

U.S. PATENT DOCUMENTS

| | | | | |
|---|---|---|---|---|
| 1,381,089 | A | 6/1921 | Beverage | |
| 1,816,614 | A | 2/1923 | Ranger | |
| 8,350,776 | B1 | 1/2013 | Bauman | |
| 2020/0278454 | A1* | 9/2020 | Feller | H01Q 9/27 |

* cited by examiner

*Primary Examiner* — Daniel Munoz
(74) *Attorney, Agent, or Firm* — Mark Bauman

(57) ABSTRACT

This disclosure includes a compact directional antenna array that has a low profile, is easy to deploy and provides a directional response over a wide range of frequencies. The array includes one or more pairs of equal length conductors that are arranged radially about the center of the array. The conductors follow the surface of a lossy medium and are each referenced to a conductive rod that is inserted into the medium. The directional response of the array is selectable by means of a series of configurable relays or switches that route some signals through a delay network to a combiner and other signals directly to the combiner.

20 Claims, 11 Drawing Sheets

| | E | W | N | S | E/W | N/S |
|---|---|---|---|---|---|---|
| K1 | | X | | X | | |
| K2 | X | X | | | X | |
| K3 | | | X | X | | X |
| A1 | X | X | X | X | | |
| A2 | X | X | X | X | X | X |

COMPACT AND LOW-PROFILE DIRECTIONAL ANTENNA ARRAY

CROSS-REFERENCES TO RELATED APPLICATIONS

This application claims priority to the provisional application No. 63/100,411 titled Low Profile Directional Antenna that was filed on Mar. 10, 2020 the disclosures of which are incorporated herein.

TECHNICAL FIELD

The present invention relates to a directional antenna array used in telecommunications, and more specifically to a low-profile directional antenna that is electronically steerable and can be rapidly deployed.

BACKGROUND OF THE INVENTION

The present invention relates generally to an antenna array for receiving and/or transmitting radio waves in a preferred direction. The present invention provides a directional response over a wide range of frequencies. The directional antenna array exhibits a directional characteristic when signals are combined from as few as two elements when each element is less than one-quarter of a wavelength long. The array is low-profile and can be installed at ground level for frequencies below 30 MHz.

An example of a directional receiving antenna is disclosed in U.S. Pat. No. 8,350,776 and is incorporated herein by reference. Here, an array of right-triangle-shaped loops are arranged about a center axis and a signal from one loop is combined with another signal that is delayed from another loop to form a directional pattern. The present invention is advantageous over the antenna described because it has a much lower profile and is able to be deployed in a stealth manner and at ground level. These characteristics make it suitable for rapid deployment.

Another example of an exceptional directional receiving antenna is described in U.S. Pat. No. 1,381,089 awarded to Harold H. Beverage. This exceptional antenna has been in use for nearly one century and has consistently provided excellent results. This antenna can be placed at minimal height or placed directly upon the surface of the ground. A major limitation of this antenna, though, is the length that is required for its deployment which often exceeds one wavelength.

SUMMARY OF THE INVENTION

One aspect of the present invention is a directional antenna array that is configured to operate over a range of frequencies and includes a rod that is located at the center of the array and is inserted into a surface of a lossy medium, and first conductor having a length and extending radially from the center of the array in a first direction and extending parallel to the surface of the lossy medium. The array also includes a second conductor of equal length to the first conductor and extends radially from the center of the array in a second direction that is opposite to the first direction and also extends parallel to the surface of the lossy medium, and a first coupler operatively connected between the first conductor and the rod. In this configuration, the first conductor and second conductor are insulated from the lossy medium and the length of each of the conductors measured in wavelengths is less than one-quarter wavelength over the range of frequencies. The first and second conductors are also located at a distance from the surface of the medium that is less than 0.002 wavelength over the range of frequencies.

The directional antenna array also includes a second coupler that is operatively connected between the second conductor and the rod, a delay network that is connected to the second coupler in signal transfer relation and is configured to provide signal time delay, a signal combiner that is connected to the first coupler in signal transfer relation and is also connected to the delay network in signal transfer relation, and the delay is fashioned to determine a directional characteristic of the antenna array.

The directional antenna array is configured to provide a directive response favoring the first direction when the signal time delay is fashioned so that signals traveling from the first direction are attenuated within the combiner by a lesser amount than signals coming from the second direction. The delay network utilized in the directional antenna array can be configured so that the signal time delay measured in nano-seconds is equal to the conductor length in meters multiplied by a factor, and wherein the factor is a number that has a value within a range of 1.70 to 2.50. A bi-directional response can be realized by setting the signal time delay to zero, or by connecting the first and second together at the center of the array.

Another aspect of the present invention is a directional antenna array that also includes a first relay contact, a second relay contact, a delay network connected to the second relay contact and configured to provide a signal delay, a signal combiner that is connected to the first relay contact, the signal combiner that is also connected to the delay network in signal transfer relation so that the array is configured to provide a directive response favoring the first direction when the first relay contact is connected in signal transferring relation to the first conductor and the second relay contact is connected in signal transferring relation to the second conductor.

The directional antenna array is configured to provide a directive response favoring the second direction when the first relay contact is connected in signal transferring relation to the second conductor and the second relay contact is connected in signal transferring relation to the first conductor.

In yet another aspect of the invention, a third, and fourth conductor each extending radially outward in a third and fourth direction with the fourth direction being opposite of the third direction, a first and second relay, a first and second buffer amplifier, a delay network connected in signal transfer relation to the first buffer amplifier and configured to provide a signal time delay, a signal combiner connected in signal transfer relation to the second buffer amplifier, the signal combiner also is connected in signal transfer relation to the delay network, and a third relay, and wherein the third relay is configured to route signals that have passed through the first and second relays to the first and second buffer amplifiers respectively when the third relay is configured in an in-active state, and further wherein the third relay is configured to route signals that have passed through the first and second relays to the second and first buffer amplifiers respectively when the third relay is configured in an active state. In this aspect, the array is configured to provide a directive response favoring the first direction when only the first relay is activated so that signals from the first conductor are routed to the second buffer amplifier and signals from the second conductor are routed to the first buffer amplifier.

In this aspect, the array is configured to provide a directive response favoring the second direction when the first and third relays are activated so that signals from the first conductor are routed to the first buffer amplifier and signals from the second conductor are routed to the second buffer amplifier. The array may also be configured so that the third and fourth conductors are connected to the rod when the array is configured in either the first or second direction.

Finally, in this aspect, the array is configured to provide a directive response favoring the third direction when only the second relay is activated so that signals from the third conductor are routed to the second buffer amplifier and signals from the fourth conductor are routed to the first buffer amplifier.

These and other aspects of the present invention will be described in greater detail hereinafter.

BRIEF DESCRIPTION OF THE DRAWINGS

The invention is described below with reference to the following accompanying drawings.

DETAILED DESCRIPTION OF THE PREFERRED EMBODIMENTS

This disclosure of the invention is submitted in furtherance of the constitutional purposes of the U.S. Patent Laws "to promote the progress of science and useful arts" (Article 1, Section 8).

Figure 1:
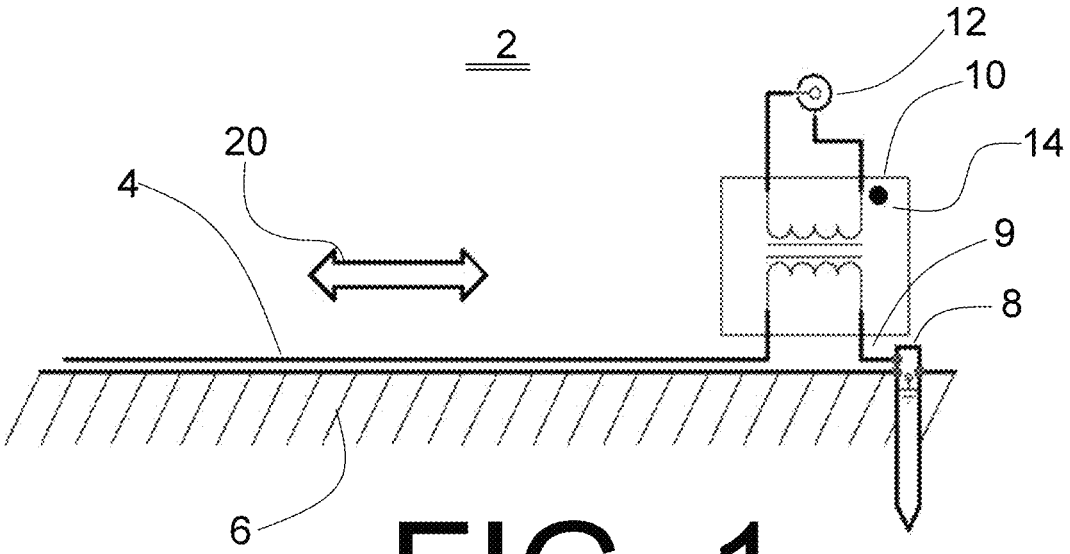
FIG. 1 is an elevation view and block diagram of a single end-fed antenna assembly element utilized in this invention.

Referring now to FIG. 1, an end-fed antenna element assembly 2 is shown in simplified form. The end-fed antenna element assembly 2 is comprised of an elongated insulated conductor 4 that is parallel to, and in proximity to, a surface of a medium 6. The medium 6 is a lossy medium having a depth, surface area and dielectric constant. The dielectric constant of the medium 6 should have a value that is different than air and this interface forms a boundary layer that is known to guide an electromagnetic wave. For frequencies less than 30 MHz, the medium 6 is the surface of a planet. This surface can be bare soil, or soil covered with vegetation such as grass. The medium 6 has a level of conductivity and both real and imaginary parts of dielectric permittivity that is a function of frequency.

A rod 8 or other conductive element is inserted into the medium 6 and provides a galvanic connection between the rod 8 and the medium 6. In practice below 30 MHz, this rod 8 is a ground rod and in one embodiment is a copper clad steel rod having a length of 100 cm and a diameter of 10 mm.

The insulated conductor 4 is connected to a coupler 10 having a phasing dot 14 and is also connected to the rod 8. The coupler 10 provides a mechanism to transfer energy to a transmission line 12. The coupler 10 can be a passive transformer or an active impedance transformation circuit such as an emitter or source follower. The line 12 may be direct connection to another circuit such as a relay or combiner, or alternatively can be a transmission line such as a coaxial cable when the signal needs to be transferred over a distance. The line 12 may also be a balanced feedline when the coupler 10 is implemented as a balun transformer to convert a singled-ended signal to a balanced differential signal.

The antenna element assembly 2 provides a bi-directional response to vertically polarized radiation as indicated by the arrow 20 when it has a length that is less than approximately one-quarter wavelength.

Figure 2:
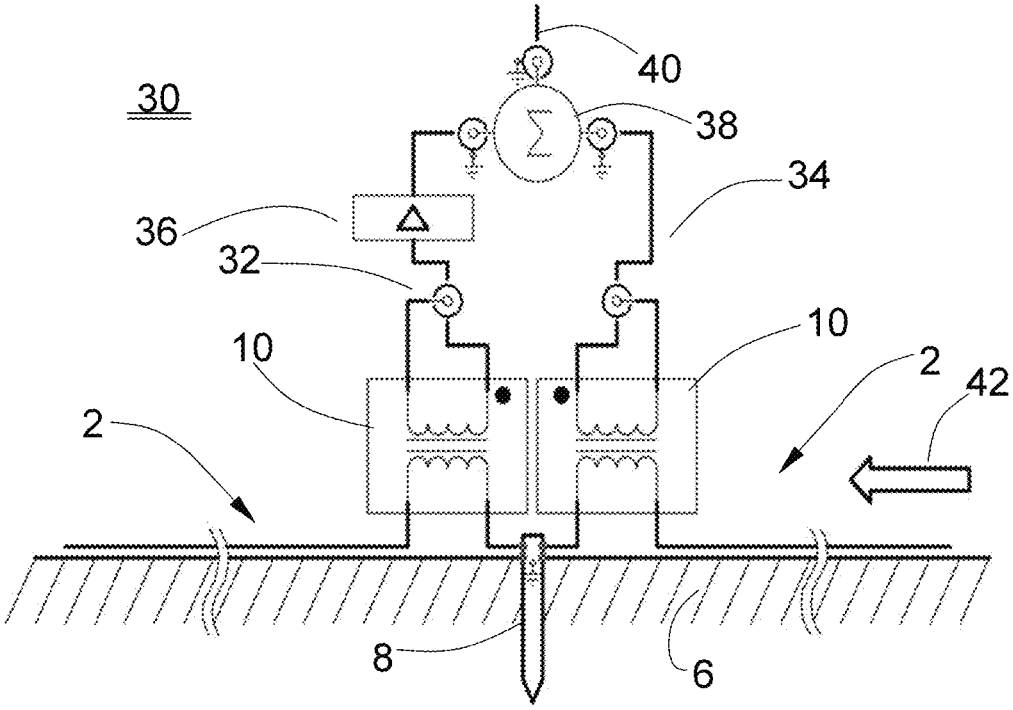
FIG. 2 is an elevation view and block diagram of a pair of end fed antenna element assemblies feeding a time-delay and combiner to provide a uni-directional characteristic.

Referring to FIG. 2, a compact and low-profile directional antenna 30 includes a pair of end-fed antenna element assemblies 2 as described earlier in this specification and arranged in mirrored and symmetrical fashion and referenced to a common or shared rod 8. These element assemblies 2 are each connected to individual and identical couplers 10. One of the couplers 10 is connected to a first transmission line 32 that is connected to a delay network 36. The network 36 can be a fixed length of transmission line, a delay circuit composed of discrete or lumped elements or a phasing network. The opposite element assembly 2 is connected to a second transmission line 34.

The delay network 36 is connected via a transmission line or direct connection to a combiner 38 having three ports that is connected to the line 34. In one embodiment, the combiner 38 is a magic-tee combiner that provides isolation between ports when it is properly terminated. Other types of combiners known in the art may also be used in this application. A combined signal is connected to transmission line 40 that is connected to a port on the combiner 38. When a directional pattern is desired in a receiving mode, the delay 36 is provided with a time delay or phase adjustment or change value that is fashioned to adjust signals coming from one of the element assemblies 2 so that signals arriving from a direction 42 are attenuated less than signals arriving from a direction that is opposite the direction 42 based on a time of arrival of the signals.

Figure 3:
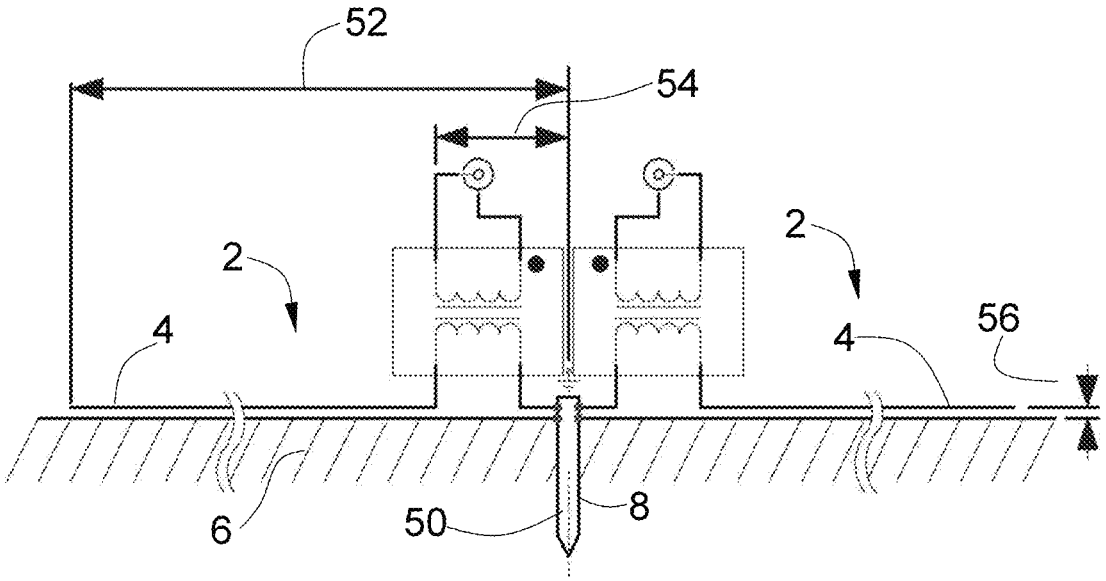
FIG. 3 is a dimensioned elevation view and block diagram of a pair of end-fed single antenna elements sharing a single ground rod.
Figure 4:
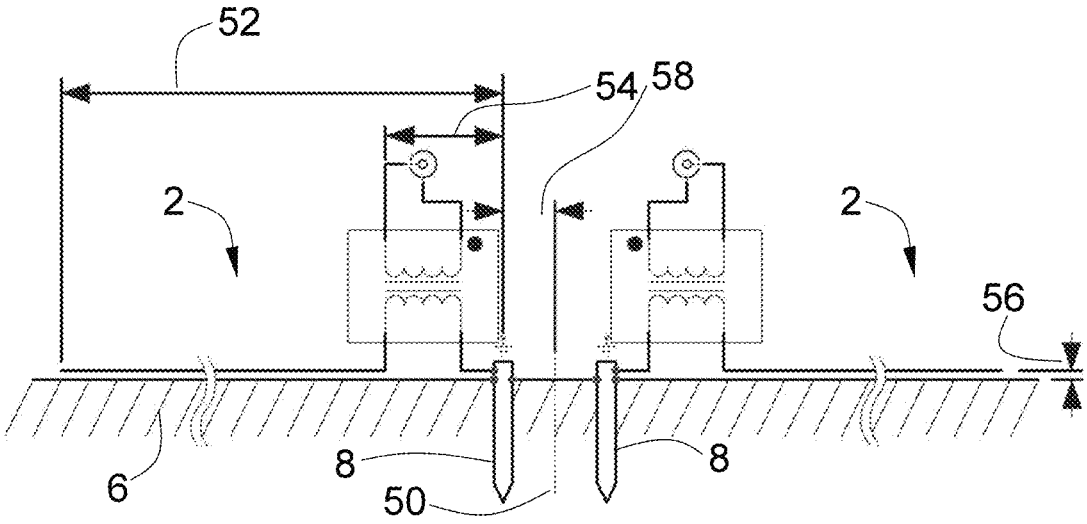
FIG. 4 is a dimensioned elevation view and block diagram of a pair of end-fed antenna elements that utilizes separate ground rods for each element.

Now referring to FIGS. 3 and 4, a pair of antenna element assemblies 2 are arranged about a center axis 50. An overall length of each end-fed element assembly 2 is approximately equal to the length of the conductor 4 and is represented by the numeral 52. A distance from the rod 8 to each coupler 10 is represented by the numeral 54. Each elongated insulated conductor 4 is positioned at a distance relative to the medium 6 and this distance is represented by the number 56.

An alternative embodiment represented in FIG. 4 where each element assembly 2 includes an individual ground rod 8 that is positioned at a distance 58 from the axis 50. In this alternative embodiment, the element assemblies 2 are configured in a similar manner as those presented in FIG. 2 and will be discussed further in this specification.

In these embodiments, each antenna element assembly 2 provides a bi-directional response over a range of frequencies when the length 52 is less than approximately one-quarter wavelength over the range of frequencies and the distance 56 is less than 0.002 wavelengths over the range of frequencies. In a preferred embodiment, the distance 54 is less than 0.01 of the distance 52. This arrangement provides a central location for signal processing and minimizes the length of any transmission lines.

In one embodiment for use over a range of frequencies from 300 KHz to 10 MHz, the length 52 is 8 meters (m), the length 54 is 3 centimeters (cm) and the distance 56 is 3 cm. In this configuration, a bi-directional response is observed for each element assembly 2. When element assemblies 2 of these dimensions are utilized in the directional antenna 30 in FIG. 2, the delay network 36 is set for a time delay of 18 nanoseconds.

Each of the dimensions 52, 54 and 56 can be selected to achieve various goals. For convenience, the dimension 54 may be kept to a minimum to simplify installation. For example, the dimension 54 may be as small as physically practical. However, an optimum dimension 54 may be greater than this minimum dimension without departing from the scope of this disclosure. In general, decreasing the dimension 52 will increase the maximum frequency where the bidirectional characteristic 20 is observed. Yet further, increasing the dimension 56 will also increase the maximum frequency. However, increasing this dimension beyond approximately 20 cm decreases the directional characteristic of the directional antenna 30 when implemented over average soil for frequencies less than about 30 MHz.

Now referring to FIGS. 2, 3 and 4, an optimum value for the time delay value in the delay network 36 is a function of the dimension 52 and will decrease as the dimension 52 is lessened in order to maintain a directional characteristic. For situations where the value of dimension 54 and 56 are small and when the medium 6 is an average earthen soil condition, the time delay can be approximated using the following relation: the time delay in nanoseconds equals the value of the dimension 52 in meters multiplied by a constant that has a value that is between 1.7 and 2.5. In one embodiment, a constant of 2.13 has been determined to provide good results. This constant is determined empirically and will vary by some amount for other types of mediums 6 that have different loss factors and dielectric constants.

The conductors 4 are commonly placed above the surface of the medium 6 so that the dimension 56 is positive. However, the dimension 56 can also be negative when the conductors 4 are placed below the surface of the medium 6 without departing from the scope of this invention.

Figure 5:
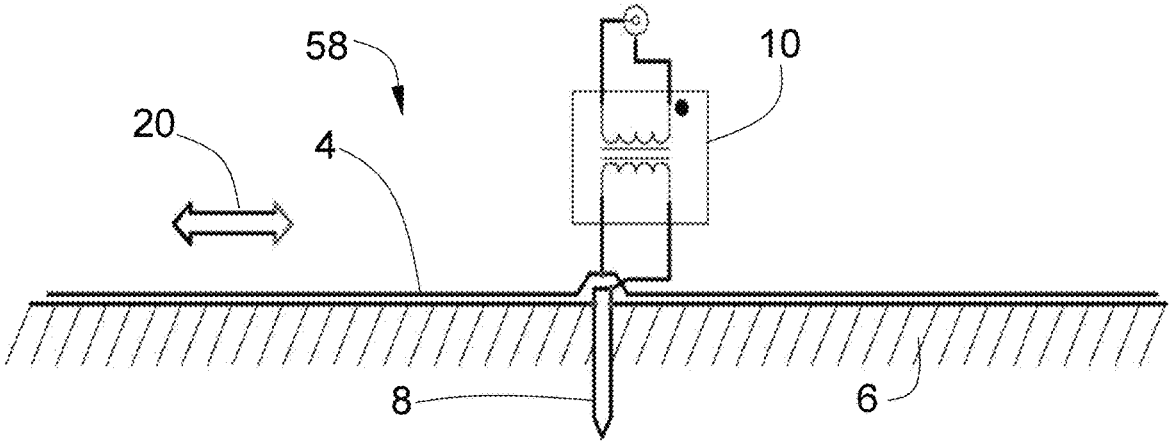
FIG. 5 is an elevation view of a center-fed single antenna element assembly that provides a bi-directional response.

Now referring to FIG. 5, a center-fed antenna element assembly 58 is presented that provides a bidirectional pattern represented by the bidirectional arrow 20. Here a pair of insulated conductors 4 are connected together forming a mid-point that is connected to a coupler 10 and a ground rod 8. This configuration provides a bi-directional pattern with suppression of an overhead response which is advantageous in some applications. Here the realized response is similar to what one might expect from the directional array 30 as described in FIG. 2 when the delay network 36 has a time delay that is equal to zero.

Figure 6:
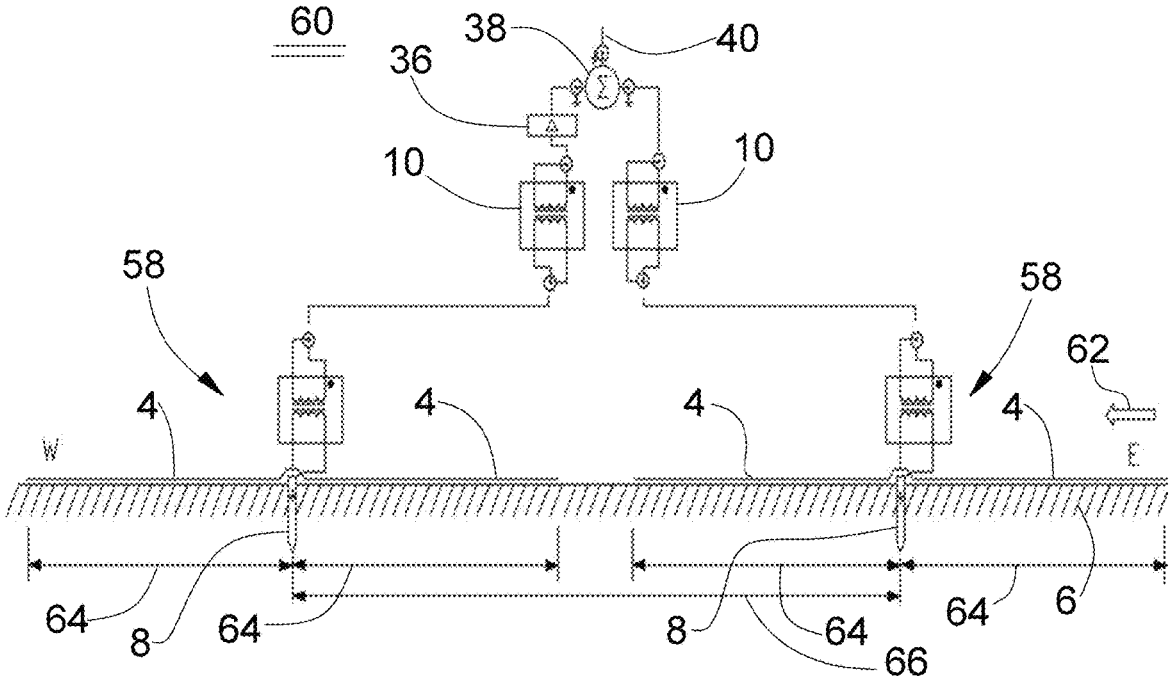
FIG. 6 is an elevation view and block diagram of a pair of mid-fed antenna element assemblies feeding a time-delay and combiner to provide a uni-directional characteristic.

Now referring to FIGS. 5 and 6, a pair of center-fed antenna element assemblies 58 are connected in a manner similar to that end-fed antenna element assemblies as 2 shown in FIG. 2 to form a directional array 60. In this embodiment, the array 60 provides exceptional rejection of signals arriving from a direction opposite the preferred direction indicated by the numeral 62. Here, each conductor 4 has a length indicated by the numeral 64 and each of their lengths are equal. Further, an mid-fed distance is indicated by the numeral 66 and should be greater than twice the conductor length 64.

Figure 7:
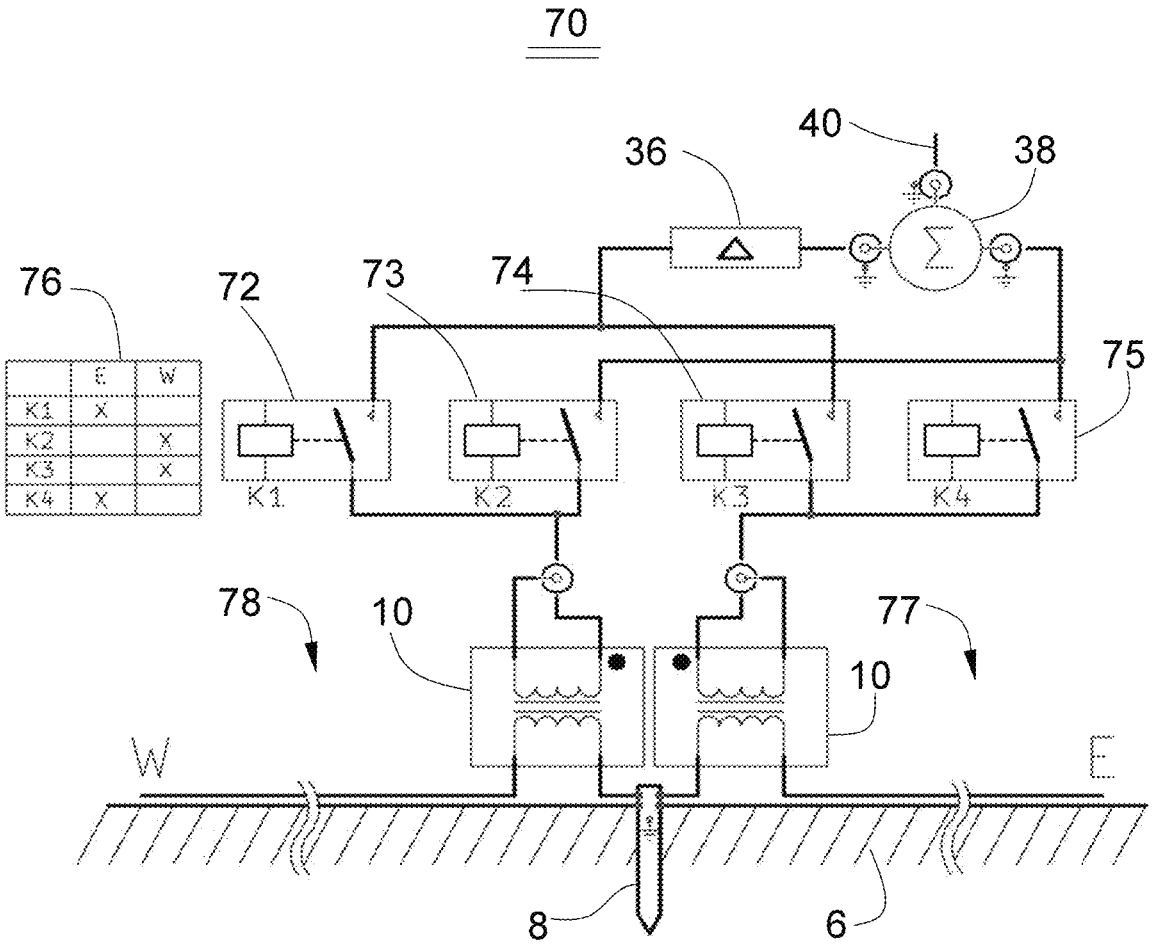
FIG. 7 is an elevation view and block diagram of a switchable uni-directional antenna that provides selection of two different favored directions.

Referring to FIG. 7, a two-direction switchable antenna array 70 includes a west antenna element assembly 78 that is referenced to the rod 8 that is inserted into the medium 6. The element in the assembly 78 extends radially outward from the rod 8 toward a direction designated by the letter W and can be understood as extending in a westerly direction. An east antenna element assembly 77 is comprised of an antenna element that is referenced to the rod 8 that is inserted into the medium 6. The element in the assembly 77 extends radially outward from the rod 8 toward a direction designated by the letter E and can be understood as extending in an easterly direction which is a direction that is opposite the westerly direction.

The west antenna element assembly 78 is connected to contacts of a first relay K1 designated by the numeral 72. The relay 72 and its associated contacts as well as all of the relays and associated contacts that will be introduced in this specification can be any type of signal switching element including electromechanical relays, mechanical switches, reed switches, solid state relays, solid state switches, pin diode switches, vactrols or opto-isolators or others know in the art without departing from the scope of this invention.

The contact of the first relay 72 is connected to the delay network 36 so that the west antenna element assembly 78 is connected to the delay network 36 when a coil within the relay 72 is activated and disconnected when it is deactivated. The west antenna element assembly 78 is also connected to the contact of a second relay K2 designated by the numeral 73. The contact of the second relay 73 is directly connected to the combiner 38 so that the west antenna element assembly 78 is connected to the combiner 38 when a coil within the relay 73 is activated and disconnected when it is deactivated.

The east antenna element assembly 77 is connected to contacts of a third relay K3 designated by the numeral 74. The contact of the third relay 74 is connected to the delay network 36 so that the east antenna element assembly 77 is connected to the delay network 36 when a coil within the relay 74 is activated and disconnected when it is deactivated. The east antenna element assembly 77 is also connected to the contact of a fourth relay K4 designated by the numeral 75. The contact of the fourth relay 75 is directly connected to the combiner 38 so that the east antenna element assembly 77 is connected to the combiner 38 when a coil within the relay 75 is activated and disconnected when it is deactivated.

A two-direction relay switching table 76 provides a tactical representation that illustrates a relationship between a configuration of the relays 72, 73, 74 and 75 and resulting directional characteristic of the directional array 70. From inspection of the table 76, it should be understood that the array 70 becomes configured to favor a direction designated by the letter E when relays K1 designated by the numeral 72 and K4 designated by the numeral 75 are configured in their activated state. In this configuration, the east antenna element assembly 77 is connected directly to the combiner 38 and the west antenna element assembly is connected directly to the delay network 36.

Yet further, from inspection of the table 76, it should be understood that the array 70 becomes configured to favor a direction designated by the letter W when relays K2 designated by the numeral 73 and K3 designated by the numeral 74 are configured in their activated state. In this configuration, the west antenna element assembly 77 is connected directly to the combiner 38 and the east antenna element assembly is connected directly to the delay network 36.

Figure 8:
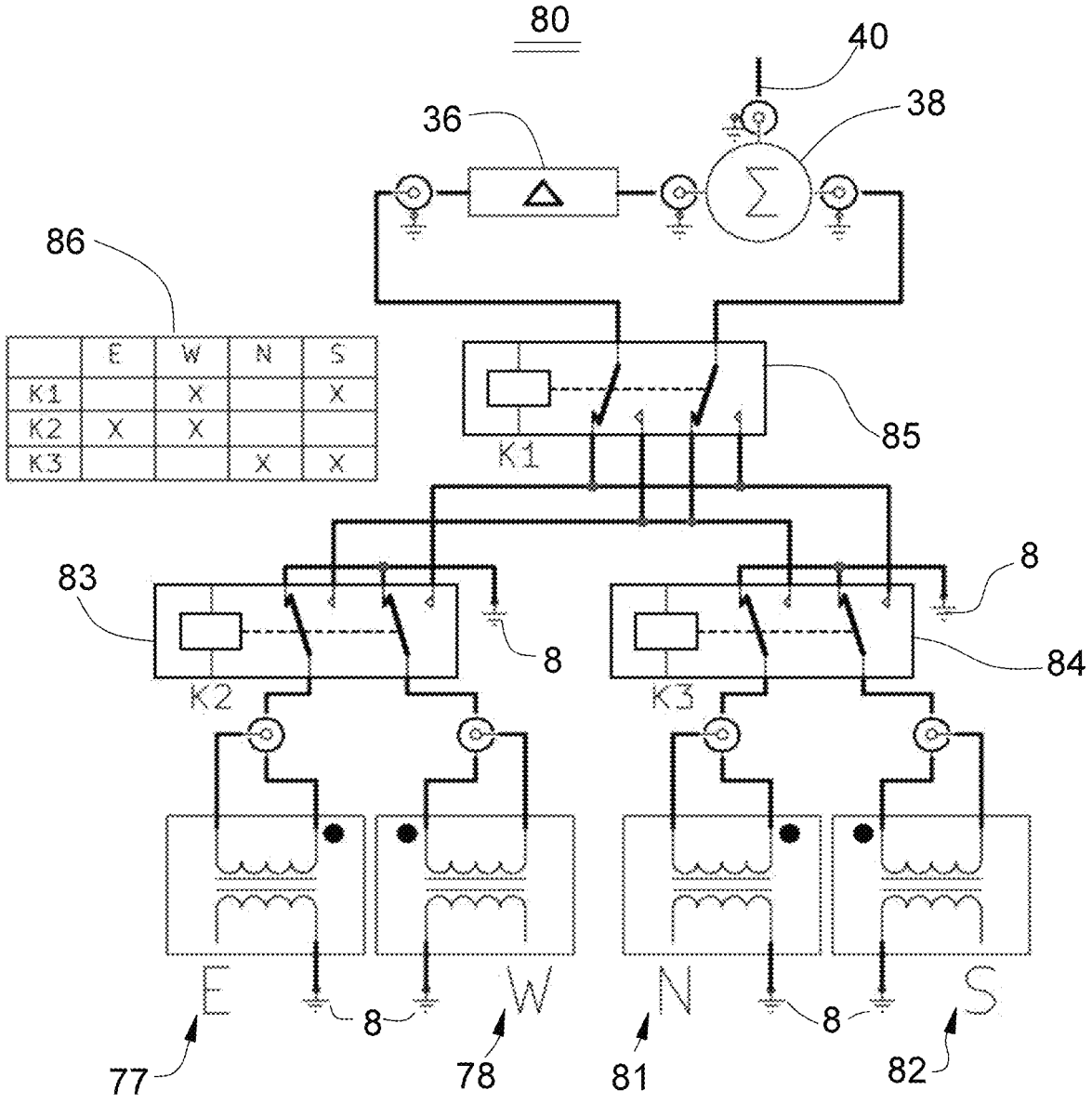
FIG. 8 is an elevation view and block diagram of a switchable uni-directional antenna that provides selection of four different favored directions using an alternate relay switching scheme.

Referring to FIG. 8, a four-direction switchable antenna array 80 includes the west antenna element assembly 78 and the east antenna element assembly 77 as described earlier in this specification. In addition, a north antenna element assembly 81 is comprised of an antenna element that is connected to a coupler that is connected to the rod 8 that is inserted into the medium 6. The element in the assembly 81 extends radially outward from the rod 8 toward a direction designated by the letter N and can be understood as extending in a northerly direction. A south antenna element assembly 82 is comprised of an antenna element that is connected to a coupler that is also connected to the rod 8 that is inserted into the medium 6. The element in the assembly 82 extends radially outward from the rod 8 toward a direction designated by the letter S and can be understood as extending in southerly and opposite direction.

The rod 8 is shown in FIG. 8 as separate symbols and can be implemented as separate ground rods if desired. Alternatively, FIG. 8 can be understood that the separate rod symbols 8 represent a common connection to a single rod 8 such that they are connected together so that each of the assemblies 77, 78, 81 and 82 share a common ground rod 8.

The west antenna element assembly 78 and east antenna element assembly 77 are each connected to the contacts of a first pair relay K2 designated by the numeral 83. Here the first pair relay 83 is a double-throw, double-pole relay where the element assemblies 77 and 78 are connected to the ground rod 8 when a coil within the relay 83 is configured in a deactivated state.

The north antenna element assembly 81 and south antenna element assembly 82 are connected to contacts of a second pair relay K3 designated by the numeral 84. Here the second pair relay 84 is a double-throw, double-pole relay where the element assemblies 81 and 82 are connected to the ground rod 8 when a coil within the relay 84 is configured in a deactivated state.

The first pair relay 83 contacts are connected to the contacts in a forward/reverse relay K1 designated by the numeral 85. The forward/reverse relay 85 is a double-throw double-pole relay. The first pole normally open and normally closed contacts are each connected to the normally open contacts of relays 83 and 84.

Specifically, the first pole normally closed contacts of relay 85 are connected to the second pole normally open contact of relay 83 and the second pole contact of relay 84 and the second pole normally closed contact of relay 85 is connected to the normally open first pole contact of relay 83 and the normally open first pole contact of relay 84. Yet further, the first pole normally open contacts of relay 85 are connected to the first pole normally open contact of relay 83 and the first pole contact of relay 84 and the second pole normally open contact of relay 85 is connected to the normally open second pole contact of relay 83 and the normally open second pole contact of relay 84.

The forward/reverse relay 85 has first pole common contact that is connected the delay network 36 that is then connected to the combiner 38 and a second pole common contact that is connected to the combiner 38. The combiner 38 is connected to the combined transmission line 40 as described earlier in this specification.

A four-direction relay switching table 86 provides a tactical representation that illustrates a relationship between a configuration of the relays 83, 84, and 85 and resulting directional characteristic of the directional array 80. From inspection of the table 86, it should be understood that the array 80 becomes configured to favor a direction designated by the letter E when relay K2 designated by the numeral 83 is provided in its activated state. In this configuration, the east antenna element assembly 77 is connected directly to the combiner 38 and the west antenna element assembly 78 is connected directly to the delay network 36.

From inspection of the table 86, it should be understood that the array 80 becomes configured to favor a direction designated by the letter W when relays K1 designated by the numeral 85 and K2 designated by the numeral 83 are provided in their activated state. In this configuration, the west antenna element assembly 78 is connected directly to the combiner 38 and the east antenna element assembly 77 is connected directly to the delay network 36.

From further inspection of the table 86, it should be understood that the array 80 becomes configured to favor a direction designated by the letter N when relay K3 designated by the numeral 84 is provided in its activated state. In this configuration, the north antenna element assembly 81 is connected directly to the combiner 38 and the south antenna element assembly 82 is connected directly to the delay network 36.

Finally, from inspection of the table 86, it should be understood that the array 80 becomes configured to favor a direction designated by the letter S when relays K1 designated by the numeral 85 and K3 designated by the numeral 84 are provided in their activated state. In this configuration, the south antenna element assembly 82 is connected directly to the combiner 38 and the north antenna element assembly 81 is connected directly to the delay network 36.

Figure 9:
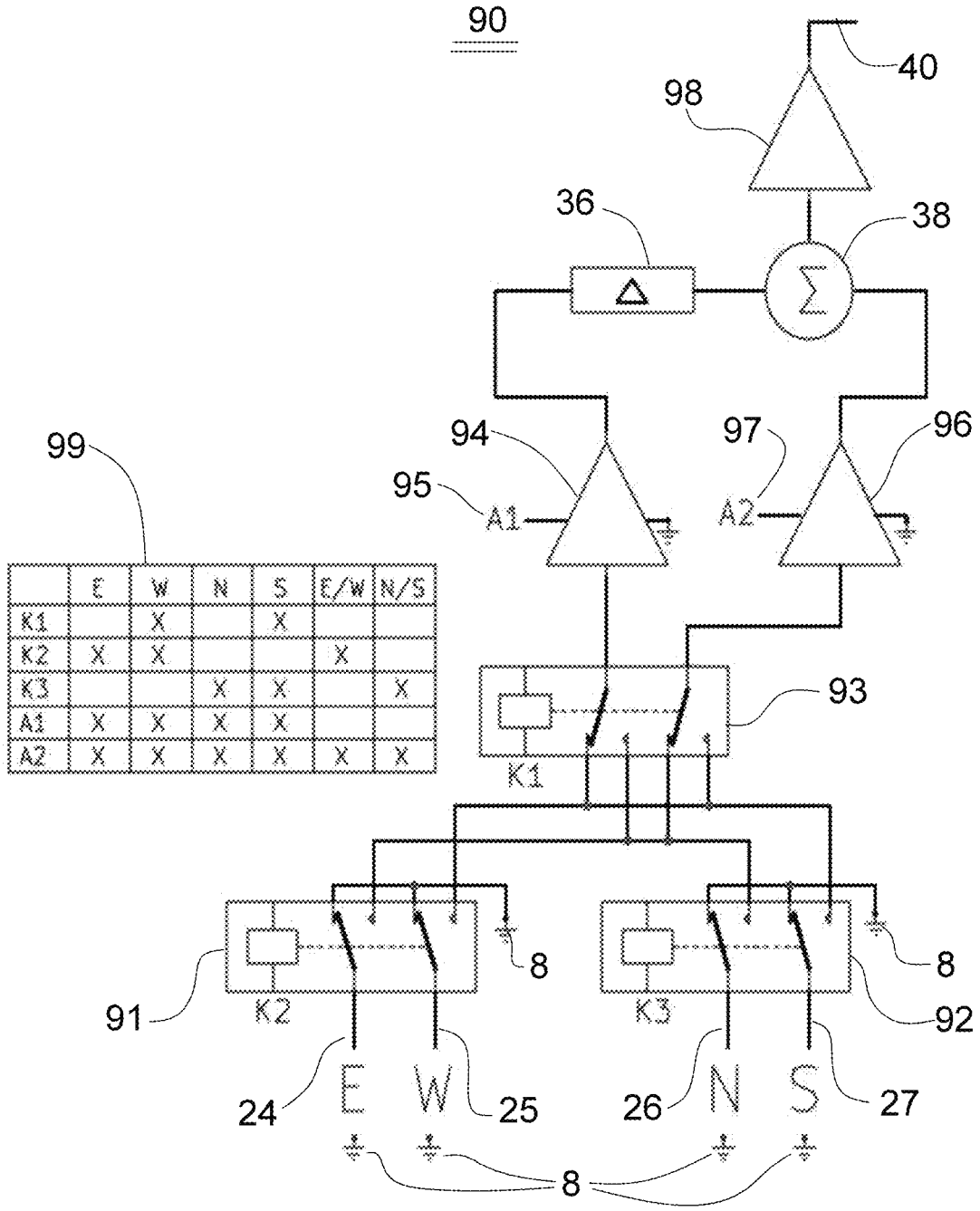
FIG. 9 is a block diagram of an antenna array with active front-end buffers that provides uni-directional operation in four different directions and bi-directional selection in two different directions.

Now referring to FIG. 9, a four-direction switchable directional array with active buffers 90 and has an east antenna element 24, a west antenna element 25, a north antenna element 26 and a south antenna element 27. Each of the elements 24, 25, 26 and 27 are insulated conductors that extend radially outward from a central point in each of their respective directions with a ground reference rod 8 (FIGS. 1 and 9) that is inserted in to the lossy medium (FIG. 1).

The rod 8 is shown in FIG. 9 as separate symbols and can be implemented as separate ground rods. Alternatively, FIG. 9 can be understood that the separate rod symbols 8 represent a common connection to a single rod 8 such that they are connected together so that each of the elements 24, 25, 26 and 27 are referenced to and share a common ground rod 8.

The west antenna element 25 and east antenna element 24 are connected to contacts of a first pair relay K2 designated by the numeral 91. Here the first pair relay 91 is a double-throw, double-pole relay where the elements 24 and 25 are connected to the ground rod 8 when a coil within the relay 91 is configured in a deactivated state.

The north antenna element 26 and south antenna element 27 are connected to contacts of a second pair relay K3 designated by the numeral 93. Here the second pair relay 93 is a double-throw, double-pole relay where the element assemblies 26 and 27 are connected to the ground rod 8 when a coil within the relay 84 is configured in a deactivated state.

The first pair relay 91 normally open contacts are connected to contacts in a forward/reverse relay K1 designated by the numeral 93. The forward/reverse relay 93 is a double-throw, double-pole relay. The first pole normally open and normally closed contacts are each connected to normally open contacts of relays 91 and 92.

Specifically, the first pole normally closed contacts of relay 93 are connected to the second pole normally open contact of relay 91 and the second pole contact of relay 92 and the second pole normally closed contact of relay 93 is connected to the normally open first pole contact of relay 91 and the normally open first pole contact of relay 92. Yet further, the first pole normally open contacts of relay 93 are connected to the first pole normally open contact of relay 91 and the first pole contact of relay 92 and the second pole normally open contact of relay 93 is connected to the normally open second pole contact of relay 91 and the normally open second pole contact of relay 92.

The forward/reverse relay 93 has first pole common contact that is connected to the input of a delayed buffer amplifier 94 having a power input 95. The output of the delayed buffer amplifier 94 is connected to the delay network 36 which is connected to the combiner 38. The relay 93 has a second pole common contact that is connected the input of a non-delayed buffer amplifier 96 that has a power input 97. The output of the non-delayed buffer amplifier 96 is connected to the combiner 38. The combiner 38 is connected to the final amplifier 98 which is connected to transmission line 40.

For best results, the buffer amplifiers 94 and should be closely matched in gain, group delay and phase response. The antenna elements 24, 25, 26 and 27 with respect to the ground rod 8 exhibit an impedance that is relatively high when their length is much less than one-quarter wavelength and progressively decreases as their length approaches one-quarter wavelength. In a preferred embodiment, the buffer amplifiers 94 and 96 are source followers. The array 90 can be configured to operate in a bi-directional manner when power is provided to only one of the buffer inputs 95 and 96 of the buffer amplifiers 94 and 96 at a time.

An array control table 99 provides a tactical representation that illustrates a relationship between a configuration of the relays 91, 92 and 93 as well as the buffer power inputs 95 and 97 and resulting directional characteristic of the directional array 90. From inspection of the table 99, it should be understood that the array 90 becomes configured to favor a direction designated by the letter E when relay K2 designated by the numeral 91 is configured in its activated state. In this configuration, the east antenna element 24 is connected directly to the non-delayed buffer amplifier 96 and the west antenna element 25 is connected directly to the delayed buffer amplifier 94. In this configuration, power is provided to both of the amplifier power inputs 95 and 97.

From inspection of the table 99, it should be understood that the array 90 becomes configured to favor a direction designated by the letter W when relays K1 designated by the numeral 93 and K2 designated by the numeral 91 are configured in their activated state. In this configuration, the west antenna element 25 is connected directly to the non-delayed buffer amplifier 94 and the east antenna element 24 is connected directly to the delayed buffer amplifier 96. In this configuration, power is provided to both of the amplifier power inputs 95 and 97.

From further inspection of the table 99, it should be understood that the array 90 becomes configured to favor a direction designated by the letter N when relay K3 designated by the numeral 92 is configured in its activated state. In this configuration, the north antenna element 26 is connected directly to the non-delayed buffer amplifier 96 and the south antenna element 25 is connected directly to the delayed buffer amplifier 94. In this configuration, power is provided to both of the amplifier power inputs 95 and 97.

From further inspection of the table 99, it should be understood that the array 90 becomes configured to favor a direction designated by the letter S when relays K1 designated by the numeral 93 and K3 designated by the numeral 92 are configured in their activated state. In this configuration, the south antenna element 27 is connected directly to the non-delayed buffer amplifier 94 and the north antenna element 24 is connected directly to the delayed buffer amplifier 96. In this configuration, power is provided to both of the amplifier power inputs 95 and 97.

Further, from inspection of the table 99, a bi-directional pattern favoring a direction from both the direction designated by the letter E and the direction designated by the letter W is realized by energizing the relay K2 designated by the numeral 91 and by providing power to the non-delayed buffer amplifier power input 97 and not providing power to the delayed buffer amplifier power input 95. Alternatively, the same results may be realized by providing power to the delayed buffer amplifier power input 95 and not providing power to the non-delayed buffer amplifier power input 97.

Finally, from inspection of the table 99, a bi-directional pattern favoring signals from both the direction designated by the letter N and the direction designated by the letter S is realized by energizing the relay K3 designated by the numeral 92 and by providing power to the non-delayed buffer amplifier power input 97 and not providing power to the delayed buffer amplifier power input 95. Alternatively, the same results may be realized by providing power to the delayed buffer amplifier power input 95 and not providing power to the non-delayed buffer amplifier power input 97.

Figure 10:
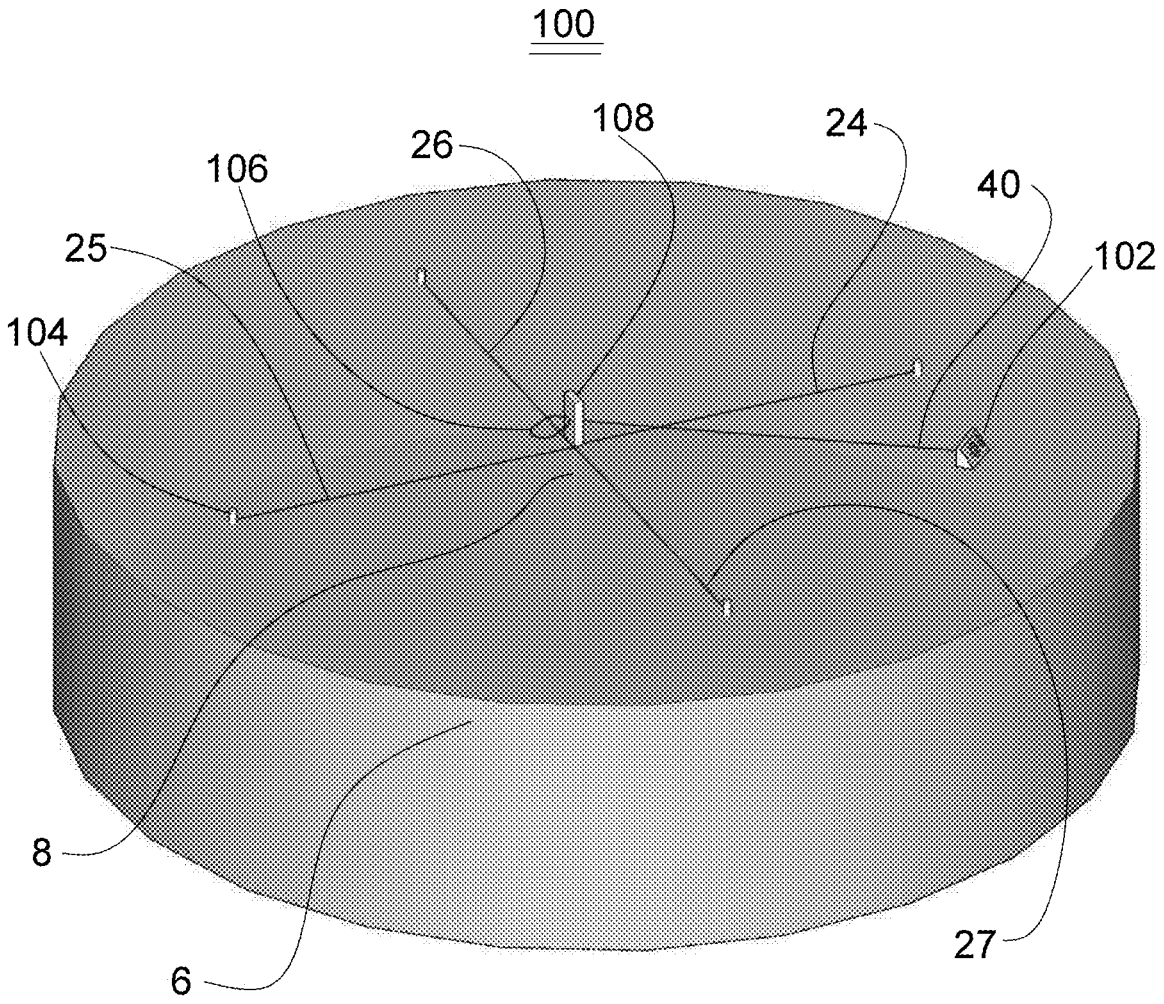
FIG. 10 is a perspective view of a four element antenna array sharing a common ground.

Now referring to FIG. 10, a four direction switchable directional array 100 is shown in a perspective view and illustrates a physical representation of either of the arrays described in FIG. 8 or 9. Here a ground rod 8 is immersed in a medium 6 and connected to a switch/combiner 108. It should be understood that the switch/combiner 108 can include any of the circuit configurations described and illustrated earlier in this specification.

Circuitry inside the switch/combiner 108 connects to an east antenna element 24, a west antenna element 25, a north antenna element 26 and a south antenna element 27. Each of the elements 24, 25, 26 and 27 and held by an insulating anchor 104 that serves to keep each element straight. The switch/combiner 108 includes a delay network 36 (not shown) that can be realized using an external delay line 106 to provide an appropriate delay to facilitate uni-directional operation of the array 100.

An output feedline 40 connects the switch/combiner 108 to a controller 102 that can be used to select a desired direction of operation. The output feedline 40 can be configured to transfer radio frequency signals as well as power and commands to operate the switch/combiner 108.

Operation

The antenna array described in this specification can be used for either receiving or transmitting. However, for the purposes of this disclosure, the operation will be described for the receiving mode only with the understanding that appropriate signal flow is reversed when operating in a transmitting mode. In addition, for this discussion, the medium 6 will be considered as existing within a horizontal plane.

Figure 11:
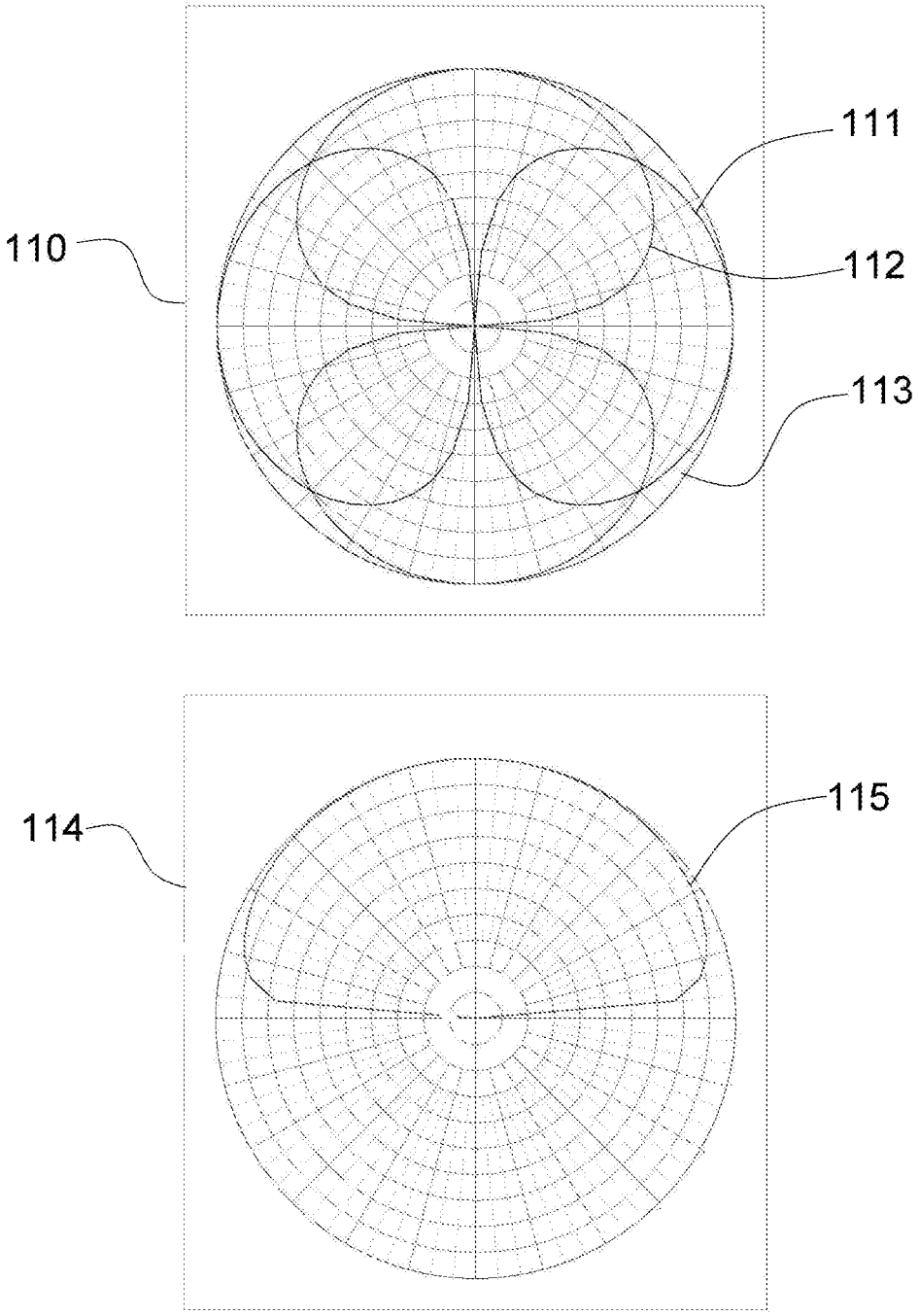
FIG. 11 is a horizontal and vertical plane antenna pattern chart for a single end-fed antenna element when the element has a length that is less than approximately one-quarter wavelength.

Referring to FIGS. 1, 3 and 11, the elongated insulated conductor 4 is spread across and in close proximity to the medium 6 and is operable to convert electromagnetic radiation into a time varying voltage signal relative to the ground rod 8. This signal appears between the input terminals of the coupler 10 where it is transformed and transferred to the transmission line 12. Vertically polarized signals will be favored due to the close proximity to the surface or medium 6 as horizontally polarized signals will be attenuated because the electric field lies in a plane that is parallel to the medium 6.

In this configuration, the direction of favored response of the antenna element assembly 2 is bi-directional as shown by the arrow 20 and follows the horizontal plane response 110 when the conductor 4 has a length 52 that is less than about one-quarter wavelength. From inspection of the response 110, a vertical polarization response 111 illustrates this end-fire characteristic. A horizontal polarization response 112 is shown having a broadside pattern, but for low frequencies, any horizontally polarized signals will be significantly attenuated through interaction with the surface 6. A total combined polarization response is shown in the trace 113. The vertical plane response plot 114 includes a total response trace 115 showing the character of the antenna element assembly 2.

Figure 12:
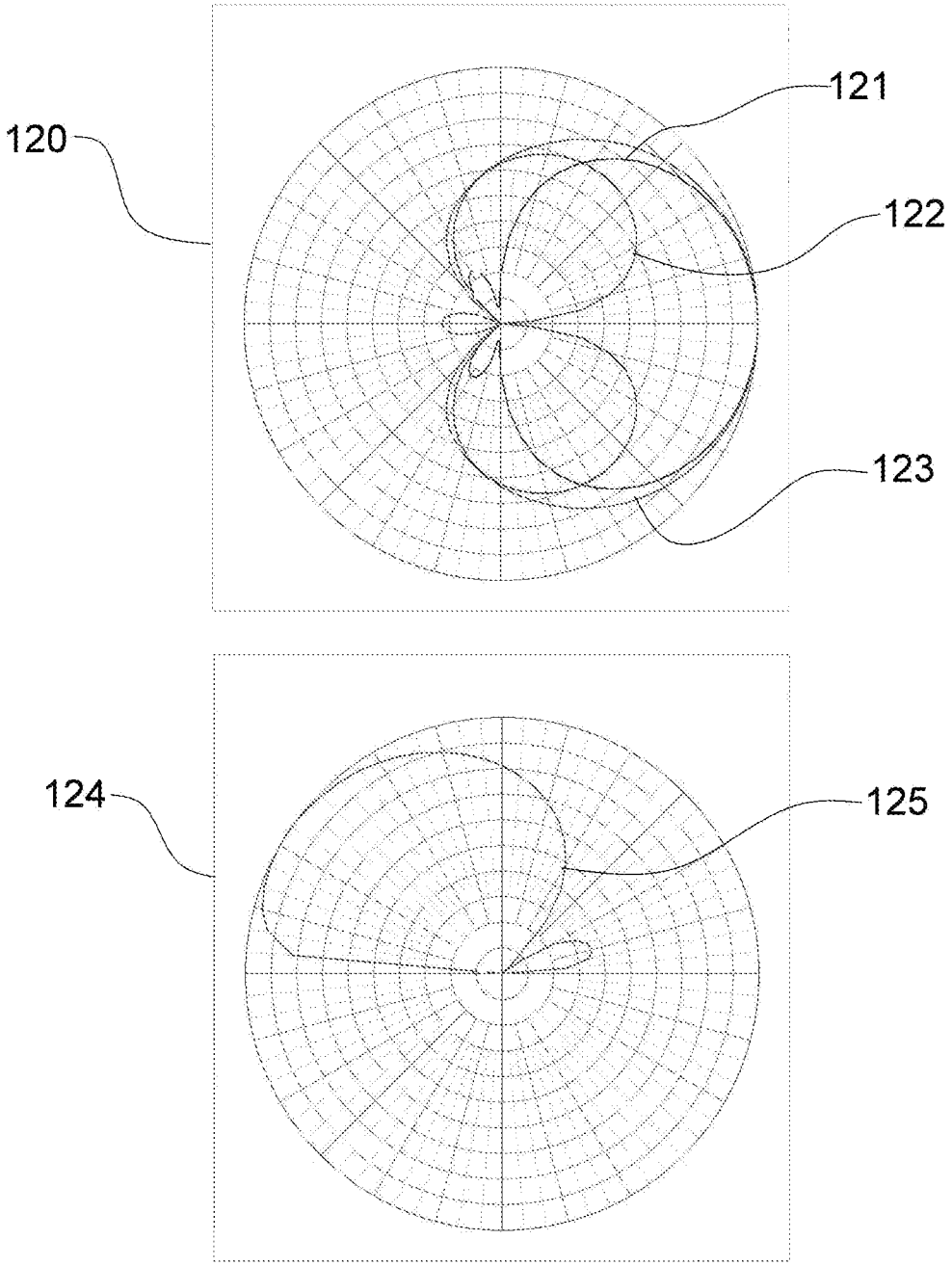
FIG. 12 is a horizontal and vertical plane antenna pattern chart for a pair of end-fed antenna elements feeding a time-delay and combiner when the time-delay is provided to approximate a time-of-arrival difference between the elements.

Referring now to FIGS. 2 and 12, a pair of antenna element assemblies 2 are configured to receive signals that are transferred through a pair of couplers 10 that are referenced to the ground rod 8 that is inserted into the medium 6. The directional antenna 30 is configured to favor reception of signals coming from the direction arrow 42 when signals from a first element assembly 2 that is located nearest to the arrow 42 are routed to the combiner 38 and when signals from a second opposite antenna element assembly 2 are routed through a delay line or network 36 and then to the combiner 38. The delay network 36 is configured to introduce a relative time delay that intentionally delays signals coming from the second antenna element assembly 2 relative to signals coming from the first antenna element assembly 2 such that a resultant signal provided by the combiner 38 has a greater amount of attenuation for signals arriving from a direction that is opposite to the direction arrow 42 than for signals arriving from a direction indicated by the arrow 42.

The resulting response pattern indicating a directive response favoring the direction indicated by the arrow 42 for the antenna 30 is provided as a horizontal plane plot 120 and a vertical plane plot 124. The trace 122 illustrates the response for horizontally polarized signals, the trace 121 illustrates the response for vertically polarized signals and the traces 123 and 125 illustrate the total combined response.

Figure 13:
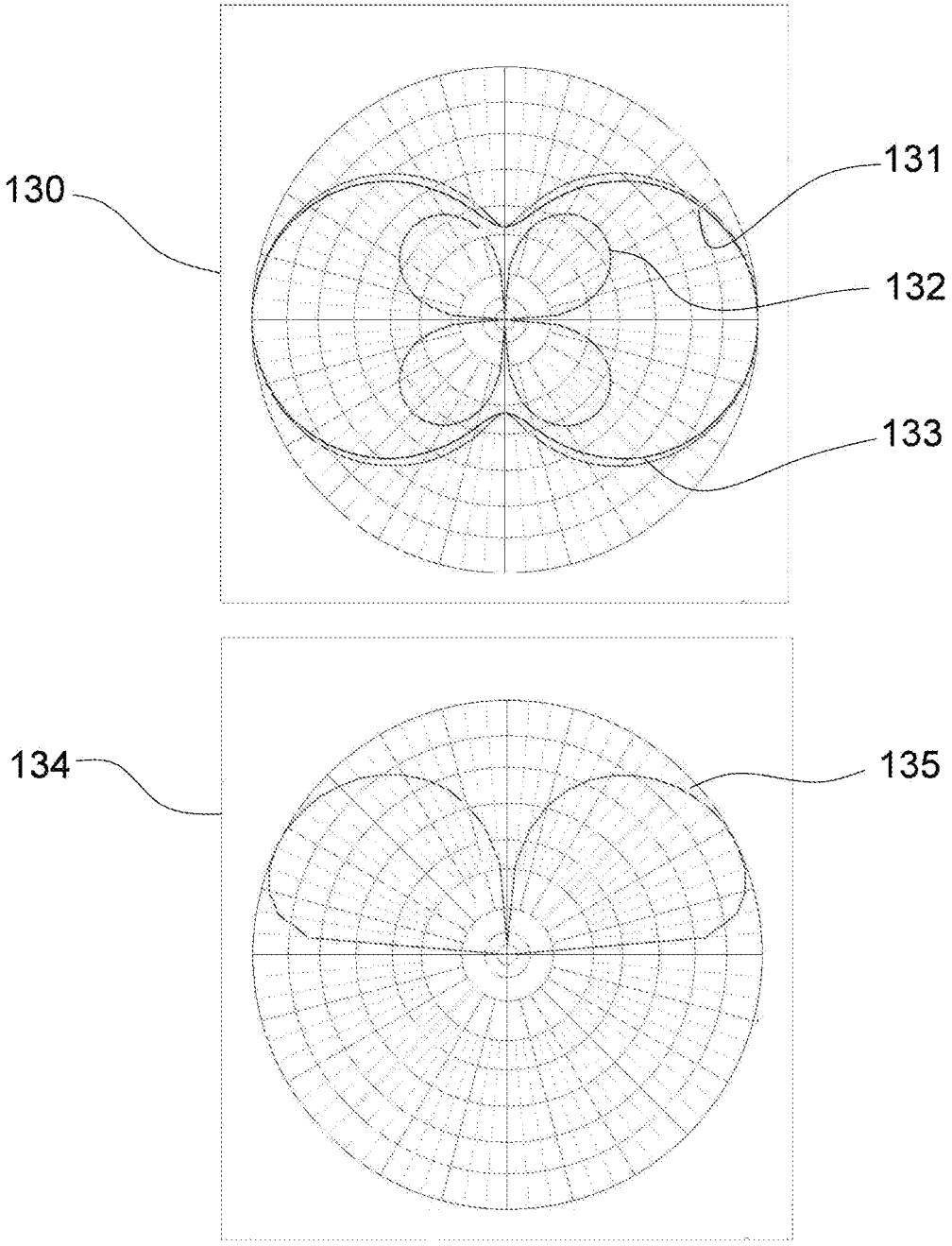
FIG. 13 is horizontal and vertical plane antenna pattern chart for a mid-fed antenna element when the total length is less than one-half wavelength.

Now referring to FIGS. 5 and 13, the center-fed antenna element assembly 58 receives signals predominantly from two directions indicated by the arrow 20. The center-fed antenna element assembly 58 is electrically similar to the directional antenna 30 (FIG. 2) when the relative delay between the antenna elements is set to a value equal to zero.

The resulting pattern for the antenna assembly 58 is provided as a horizontal plane plot 130 and a vertical plane plot 134. The trace 132 illustrates the response for horizontally polarized signals, the trace 131 illustrates the response for vertically polarized signals and the traces 133 and 135 illustrate the total combined response.

Figure 14:
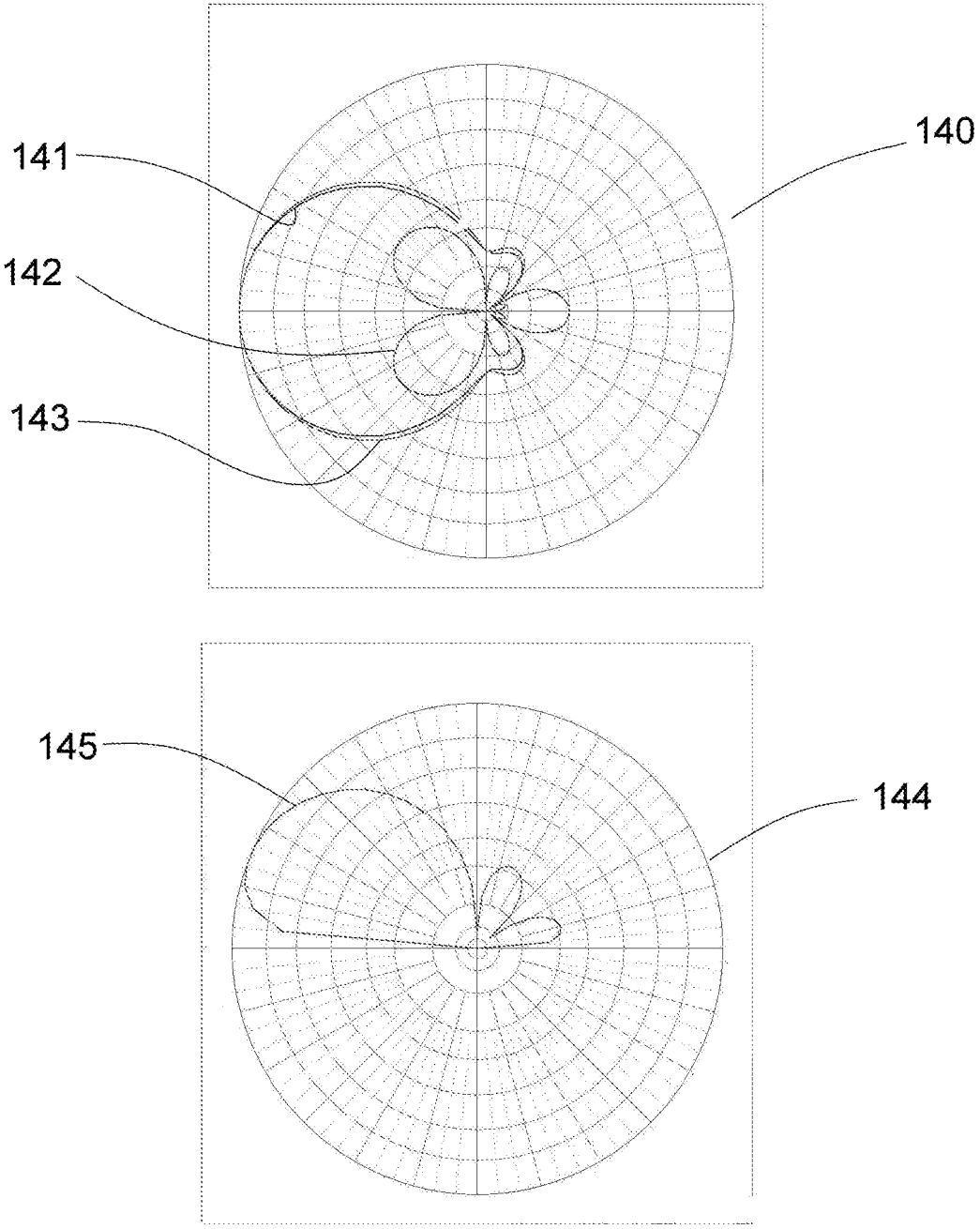
FIG. 14 is horizontal and vertical plane antenna pattern chart for a pair of mid-fed antenna elements feeding a time-delay and combiner when the time-delay is provided to approximate a time-of-arrival difference between the elements.

Now referring to FIGS. 6 and 14 a pair of center-fed antenna element assemblies 58 are configured to receive signals that are transferred through a pair of couplers that are referenced to the localized ground rod 8 that is inserted into the medium 6. The directional array 60 is configured to favor reception of signals coming from a direction indicated by the arrow 62 when signals from a first center-fed element assembly 58 that is located nearest to the arrow 62 are routed to the combiner 38 and when signals from a second opposite center-fed element assembly 58 are routed through the delay line or network 36 and then to the combiner 38. The delay network 36 introduces a relative time delay that intentionally delays signals coming from the second element assembly 58 relative to signals coming from the first element assembly 58 such that a resultant signal provided by the combiner 38 has a greater level of attenuation for signals arriving from a direction that is opposite to the arrow 62 than for signals arriving from a direction indicated by the arrow 62.

The resulting pattern for the antenna 60 is provided as a horizontal plane plot 140 and a vertical plane plot 144. The trace 142 illustrates the response for horizontally polarized signals, the trace 141 illustrates the response for vertically polarized signals and the traces 143 and 145 illustrate the total combined response.

Now referring to FIG. 7, the two-direction switchable array 70 is operable to provide an antenna response shown in FIG. 12 when the antenna element assemblies 77 and 78 are each configured as shown in FIG. 1. Alternatively, array 70 is operable to provide an antenna response as shown in FIG. 14 when the antenna element assemblies 77 and 78 are each configured as shown in FIG. 5.

The relay switching table 76 describes the necessary state of the relay contacts to achieve favorable reception in the respective direction indicated in the top row of the table 76. To configure the array 70 to favor reception of signals from the east direction labeled as "E", the relay 72 contact is closed allowing signals from the west antenna assembly 78 to enter the delay network 36 and then to the combiner 38. In addition, the relay 75 contact is closed allowing signals from the east antenna assembly 77 to enter the combiner 38 and combine with the delayed signals from the west antenna assembly 78. The combined signal is provided to the transmission line 40. The time required to provide the directional response for the delay network 36 has been described earlier in this specification.

To configure the array 70 to favor reception of signals from the west as direction labeled as "W", the relay 74 contact is closed allowing signals from the east antenna assembly 77 to enter the delay network 36 and then to the combiner 38. In addition, the relay 73 contact is closed allowing signals from the west antenna assembly 78 to enter the combiner 38 and combine with the delayed signals from the east antenna assembly 78. The combined signal is provided to the transmission line 40.

Now referring to FIG. 8, the four-direction switchable array 80 is operable to provide an antenna response shown in FIG. 12 when the antenna element assemblies 77, 78, 81 and 82 are end-fed and configured in a manner illustrated in FIG. 1. Alternatively, array 80 is operable to provide an antenna response shown in FIG. 14 when the antenna element assemblies 77, 78, 81 and 82 are mid-fed and configured in a manner illustrated in FIG. 5. The relay switching table 86 describes the necessary state of the relay contacts to achieve favorable reception in the respective direction.

To configure the array 80 to favor reception of signals from the east direction labeled as "E", the relay 83 is operated so that its normally open contacts are closed so that signals from the east antenna element assembly 77 and west antenna element assembly 78 pass through to the normally closed contacts of relay 85 so that the east signal is routed directly to the combiner 38 while the west signal is routed through the delay network 36 and then to the combiner 38 where the resulting signal becomes available at the transmission line 40.

To configure the array 80 to favor reception of signals from the east direction labeled as "W", the relay 83 is operated so that its normally open contacts are closed so that signals from the east antenna element assembly 77 and west antenna element assembly 78 pass through to the normally open contacts of relay 85. In this configuration, the relay 85 is activated so that its normally open contacts are closed allowing the west signal to be routed directly to the combiner 38 while the east signal is routed through the delay network 36 and then to the combiner 38 where the resulting signal becomes available at the transmission line 40.

To configure the array 80 to favor reception of signals from the north direction labeled as "N", the relay 84 is operated so that its normally open contacts are closed so that signals from the north antenna element assembly 81 and south antenna element assembly 82 pass through to the normally closed contacts of relay 85 so that the north signal is routed directly to the combiner 38 while the south signal is routed through the delay network 36 and then to the combiner 38 where the resulting signal becomes available at the transmission line 40.

To configure the array 80 to favor reception of signals from the south direction labeled as "S", the relay 84 is operated so that its normally open contacts are closed so that signals from the south antenna element assembly 81 and south antenna element assembly 82 pass through to the normally open contacts of relay 85. In this configuration, the relay 85 is activated so that its normally open contacts are closed allowing the south signal to be routed directly to the combiner 38 while the north signal is routed through the delay network 36 and then to the combiner 38 where the resulting signal becomes available at the transmission line 40.

Now referring to FIGS. 9 and 10, the four-direction switchable array 90 is operable to provide an antenna response shown in FIG. 12 when the controller 102 provides commands to the switch/combiner 108 to follow the control table 99 for any of the directions labeled as E, W, N or S shown and the delay network 36 or delay line 106 is configured to provide an appropriate time delay to provide a directional response as described earlier in this specification.

Yet further, array 90 and 100 are operable to provide an antenna response shown in FIG. 13 when the controller 102 commands the switch/combiner 108 to be configured in any of the directions labeled as E, W, N or S shown the control table 99 and when the delay network 36 is set to a zero time delay.

Finally, the array 90 and 100 are operable to provide an antenna response shown in FIG. 11 when the controller 102 commands the switch/combiner 108 to be configured in any of the directions labeled as E/W or NUS as shown the control table 99.

To configure the array 90 to favor reception of signals from the east direction labeled as "E", the relay 91 is operated so that its normally open contacts are closed so that signals from the east element 24 and west element 25 pass through to the normally closed contacts of relay 93 so that the east signal is routed through the activated amplifier 96 to the combiner 38 while the west signal is routed through the activated amplifier 94 to the delay network 36 and then to the combiner 38. The resulting signal is routed through the amplifier 98 and provided to the transmission line 40.

To configure the array 90 to favor reception of signals from the west direction labeled as "W", the relay 91 is operated so that its normally open contacts are closed so that signals from the west element 25 and east element 24 pass to the normally open contacts of relay 93. These normally open contacts become closed since relay 93 is activated according to table 99 so that the west signal is routed through the activated amplifier 96 to the combiner 38 while the east signal is routed through the activated amplifier 94 to the delay network 36 and then to the combiner 38. The resulting signal is routed through the amplifier 98 and provided to the transmission line 40.

To configure the array 90 to favor reception of signals from the north direction labeled as "N", the relay 92 is operated so that its normally open contacts are closed so that signals from the north element 26 and south element 27 pass through to the normally closed contacts of relay 93 so that the north signal is routed through the activated amplifier 96 to the combiner 38 while the south signal is routed through the activated amplifier 94 to the delay network 36 and then to the combiner 38. The resulting signal is routed through the amplifier 98 and provided to the transmission line 40.

To configure the array 90 to favor reception of signals from the south direction labeled as "S", the relay 92 is operated so that its normally open contacts are closed so that signals from the south element 27 and north element 26 pass to the normally open contacts of relay 93. These normally open contacts become closed since relay 93 is activated according to table 99 so that the south signal is routed through the activated amplifier 96 to the combiner 38 while the north signal is routed through the activated amplifier 94 to the delay network 36 and then to the combiner 38. The resulting signal is routed through the amplifier 98 and provided to the transmission line 40.

To configure the array 90 to favor reception of signals from both an east and west direction labeled as "E/W", the relay 91 is operated so that its normally open contacts are closed so that signals from the east element 24 and west element 25 pass through to the normally closed contacts of relay 93 so that the east signal is routed through the activated amplifier 96 to the combiner 38 while the west signal is routed to, but blocked by, the de-activated amplifier 94. The resulting signal is routed through the amplifier 98 and provided to the transmission line 40.

To configure the array 90 to favor reception of signals from both a north and south direction labeled as "N/S", the relay 92 is operated so that its normally open contacts are closed so that signals from the north element 26 and south element 27 pass through to the normally closed contacts of relay 93 so that the north signal is routed through the activated amplifier 96 to the combiner 38 while the south signal is routed to, but blocked by, the de-activated amplifier 94. The resulting signal is routed through the amplifier 98 and provided to the transmission line 40.

In compliance with the statute, the invention has been described in language more or less specific as to structural and methodical features. It is to be understood, however, that the invention is not limited to the specific features shown and describe, since the means herein disclosed comprise preferred forms of putting the invention into effect. The invention is, therefore, claimed in any of its forms or modifications within the proper scope of the appended claims appropriately interpreted in accordance with the doctrine of equivalents.

I claim:

1. A directional antenna array configured to operate over a range of frequencies comprising:

a rod located at the center of the array and inserted into a lossy medium having a surface;

a first conductor having a length and extending radially from the center of the array in a first direction and extending parallel to the surface of the lossy medium;

a second conductor of equal length to the first conductor and extending radially from the center of the array in a second direction that is opposite to the first direction and extending parallel to the surface of the lossy medium;

a first coupler operatively connected between the first conductor and the rod; and wherein the first conductor and second conductor are insulated from the lossy medium and the length of each of the conductors measured in wavelengths is less than one-quarter wavelength over the range of frequencies and the first and second conductors are located at a distance from the surface of the medium that is less than 0.002 wavelength over the range of frequencies.

2. The directional antenna array of claim 1, further comprising:

a second coupler operatively connected between the second conductor and the rod;

a delay network connected to the second coupler in signal transfer relation and configured to provide signal time delay;

a signal combiner that is connected to the first coupler in signal transfer relation and is also connected to the delay network in signal transfer relation; and wherein the signal time delay is selected to implement a specific directional response.

3. The directional antenna array of claim 2, and wherein the signal time delay measured in nano-seconds is equal to the conductor length in meters multiplied by a factor, and wherein the factor is a number that has a value within a range of 1.70 to 2.50.

4. The directional antenna array of claim 2, and wherein the array is configured to provide a directive response favoring the first direction when the signal time delay is fashioned so that signals traveling from the first direction are attenuated within the combiner by a lesser amount than signals coming from the second direction.

5. The directional antenna array of claim 2, and wherein the first and second couplers are each buffer amplifiers.

6. The directional antenna array of claim 1, and wherein the first and second conductors are connected together at the center of the array.

7. A directional antenna array configured to operate over a range of frequencies comprising:

a rod that is located at the center of the array and inserted into a lossy medium;

a first conductor having an end that is located near the center of the array, the conductor having a length and extending radially in a first direction and extending parallel to the surface of the lossy medium;

a second conductor having an end that is located near the center of the array, the conductor having a length that is equal to the length of the first conductor, and extending radially in a second direction that is opposite the first direction and extending parallel to the surface of the lossy medium;

a first relay contact;

a second relay contact;

a delay network connected to the second relay contact and configured to provide a signal delay;

a signal combiner that is connected in signal transfer relation to the first relay contact, the signal combiner is also connected to the delay network in signal transfer relation; and wherein the array is configured to provide a directive response favoring the first direction when the first relay contact is connected in signal transferring relation to the first conductor and the second relay contact is connected in signal transferring relation to the second conductor so that signals from the first conductor are routed directly to the signal combiner and signals from the second conductor are routed through the delay network and then to the signal combiner.

8. The directional antenna array of claim 7, wherein the first conductor and second conductor are insulated from the lossy medium and the length of each of the conductors measured in wavelengths is less than one-quarter wavelength over the range of frequencies and the first and second conductors are located at a distance from the surface of the medium that is less than 0.002 wavelength over the range of frequencies.

9. The directional antenna array of claim 8, and wherein the signal time delay measured in nano-seconds is equal to the conductor length in meters multiplied by a factor, and wherein the factor is a number that has a value within a range of 1.70 to 2.50.

10. The directional antenna array of claim 8, and wherein the array is configured to provide a directive response favoring the second direction when the first relay contact is connected in signal transferring relation to the second conductor and the second relay contact is connected in signal transferring relation to the first conductor so that signals from the second conductor are routed directly to the signal combiner and signals from the first conductor are routed through the delay network and then to the signal combiner.

11. The directional antenna array of claim 8, and wherein the array is configured to provide a directive response favoring the first direction when the signal time delay is fashioned so that signals traveling from the first direction are attenuated within the signal combiner by a lesser amount than signals coming from the second direction.

12. A directional antenna array configured to operate over a range of frequencies comprising:

a rod located at the center of the array and inserted into a lossy medium, and wherein the lossy medium has a surface;

a first, second, third, and fourth conductor each extending radially outward in a first, second, third and fourth direction, wherein the second direction is opposite the first direction and the fourth direction is opposite the third direction;

a first and second relay;

a first and second buffer amplifier;

a delay network connected in signal transfer relation to the first buffer amplifier and configured to provide a signal time delay;

a signal combiner connected in signal transfer relation to the second buffer amplifier, the signal combiner also is connected in signal transfer relation to the delay network; and a third relay configured to route signals that have passed through the first and second relays to the first and second buffer amplifiers respectively when the third relay is configured in an in-active state, and further wherein the third relay is configured to route signals that have passed through the first and second relays to the second and first buffer amplifiers respectively when the third relay is configured in an active state.

13. The directional antenna array of claim 12, wherein the array is configured to provide a directive response favoring the first direction when only the first relay is activated so that signals from the first conductor are routed to the second buffer amplifier and signals from the second conductor are routed to the first buffer amplifier.

14. The directional antenna array of claim 13, wherein the array is configured to provide a directive response favoring the first direction when the signal time delay is fashioned so that signals traveling from the first direction are attenuated within the signal combiner by a lesser amount than signals coming from the second direction.

15. The directional antenna array of claim 14, wherein the array is configured to provide a directive response favoring the second direction when the first and third relays are activated so that signals from the first conductor are routed to the first buffer amplifier and signals from the second conductor are routed to the second buffer amplifier.

16. The directional antenna array of claim 15, wherein the array is configured to provide a directive response favoring the third direction when only the second relay is activated so that signals from the third conductor are routed to the second buffer amplifier and signals from the fourth conductor are routed to the first buffer amplifier.

17. The directional antenna array of claim 14, wherein the third and fourth conductors are connected to the rod when the array is configured in either the first or second direction.

18. The directional antenna array of claim 13, wherein the first, second, third and fourth conductors are insulated from the lossy medium and the length of each of the conductors measured in wavelengths is less than one-quarter wavelength over the range of frequencies.

19. The directional antenna array of claim 18, wherein the first, second, third and fourth conductors extend in a manner that is parallel to the surface of the lossy medium and are located at a distance from the surface of the medium that is less than 0.002 wavelength over the range of frequencies.

20. The directional antenna array of claim 19, wherein the array is configured to provide a directive response favoring the first direction when the signal time delay measured in nano-seconds is equal to the conductor length in meters multiplied by a factor, and wherein the factor is a number that has a value within a range of 1.70 to 2.50.

* * * * *